US005600205A

United States Patent [19]

Foss et al.

[11] Patent Number: 5,600,205

[45] Date of Patent: Feb. 4, 1997

[54] BENT TUBE LAMP

[75] Inventors: Robert A. Foss, Hesperia; Patrick M. Lewis, Diamond Bar; Michael P. Duffey, Hesperia, all of Calif.

[73] Assignee: UVP, Inc., Upland, Calif.

[21] Appl. No.: 378,683

[22] Filed: Jan. 26, 1995

[51] Int. Cl.[6] ..... H01J 61/30

[52] U.S. Cl. ..... 313/634; 313/610

[58] Field of Search ..... 313/634, 610, 313/484, 493

[56] References Cited

U.S. PATENT DOCUMENTS

| | | | |
|---|---|---|---|
| 1,643,719 | 9/1927 | Loeck | 313/634 |
| 1,939,413 | 12/1933 | Robinson | 313/634 |
| 2,123,709 | 7/1938 | Bristow et al. | 313/610 |
| 3,271,612 | 9/1966 | Keller | 313/610 |
| 4,173,730 | 11/1979 | Young et al. . | |
| 4,994,705 | 2/1991 | Linder et al. | 313/634 |
| 5,272,406 | 12/1993 | Chakrabarti et al. | 313/610 |

*Primary Examiner*—Sandra L. O'Shea
*Assistant Examiner*—Matthew J. Esserman
*Attorney, Agent, or Firm*—Lyon & Lyon

[57] ABSTRACT

A lamp including an elongate tube with a septum extending longitudinally therethrough to near the distal end of the tube. A pair of assembled leads and electrodes are positioned in the tube through the terminal end and the tube sealed. With an end cap on the distal end of the tube, an elongate cavity is formed extending along either side of the septum and joined at the distal end. A bend is made in the tube such that the ends of the electrodes extend into areas within the elongate cavity between the bend and the distal end of the tube.

2 Claims, 1 Drawing Sheet

BENT TUBE LAMP

BACKGROUND OF THE INVENTION

The field of the present invention is lamps.

Lamps have been manufactured which include a sealed tube with a septum extending through the major length of the tube cavity. The cavity on either side of the septum is connected at the distal end of the tube. Electrodes are placed on either side of the septum and energized so that gas throughout the tube cavity on either side of the septum generate electromagnetic radiation.

Specialty lamps of this type have been made which include a bend in the lamp tube. The bend is accomplished through a heating of the glass tube. To avoid cross-sectional shrinking of the heated tube during bending, the bend is made before vacuum is drawn on the tube. The electrode is then placed in the tube with the bend between the electrode and the distal end of the tube. A vacuum is then drawn on the tube with the electrode assemblies loose in the tube between the terminal end of the tube and the bend. The tube is heated around a portion of the electrode assemblies to shrink the tube in cross section under the influence of the vacuum inside. This operation sets and seals the tube around the electrode assemblies. The terminal end of the tube may then be cut off to expose one end of the electrode assemblies.

Such conventional lamps work satisfactorily when properly formed. However, the bending process can crimp the tube and cut off the desired communication between electrodes through the lamp cavity. Under these circumstances, the lamp is a reject. Also, because the ends of the electrodes are before the bend, light is frequently generated in the bend. This is undesirable and under certain circumstances can lead to rejection of the lamp. Significant costs accrue in either avoiding rejects in detailed manufacture or manufacturing and discarding rejects.

SUMMARY OF THE INVENTION

The present invention is directed to lamps having an elongate tube with a septum extending through a significant length of the tube cavity. Electrodes are placed to either side of the septum. The tubes are bent but the electrodes are positioned such that any crimping of the tube at the bend will not result in lamp failure.

A lamp defined by a bent elongate tube with a septum therein is contemplated with electrodes the ends of which extend to between the bend and the distal end of the tube. Even with crimping of the tube on or behind the electrode, failure of the lamp will not occur.

In view of the foregoing, it is an object of the present invention to provide an improved lamp. Other and further objects and advantages will appear hereinafter.

DETAILED DESCRIPTION OF THE PREFERRED EMBODIMENT

Figure 1:
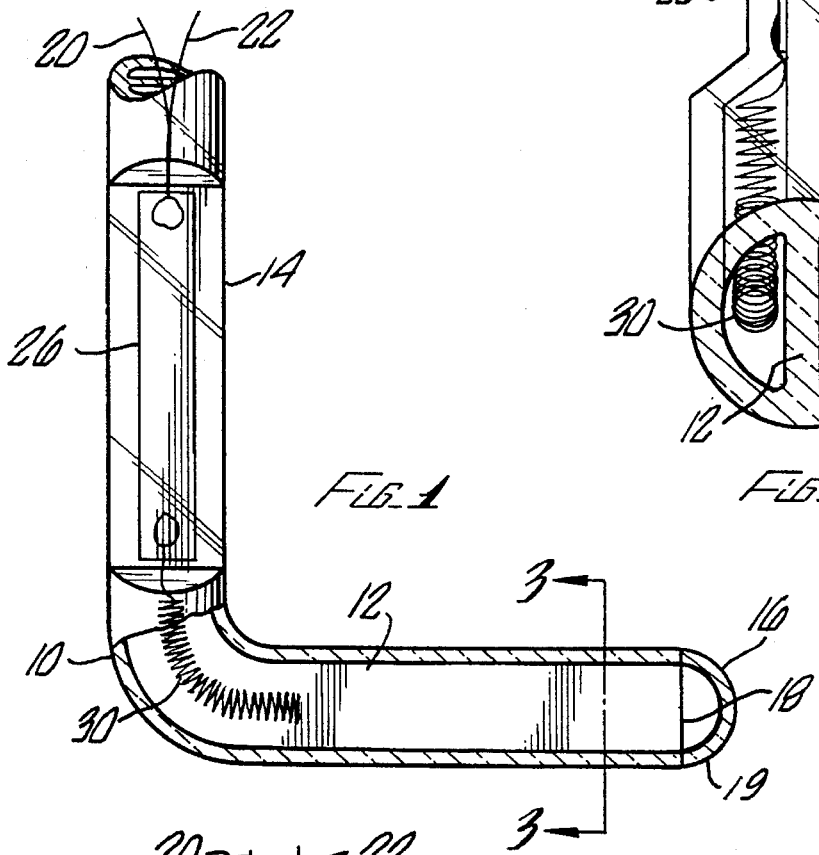
FIG. 1 is a side view of a lamp.
Figure 3:
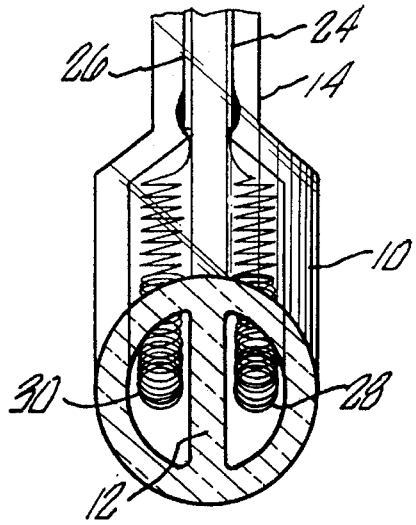
FIG. 3 is a cross-sectional view taken along line 3—3 of FIG. 1.
Figure 2:
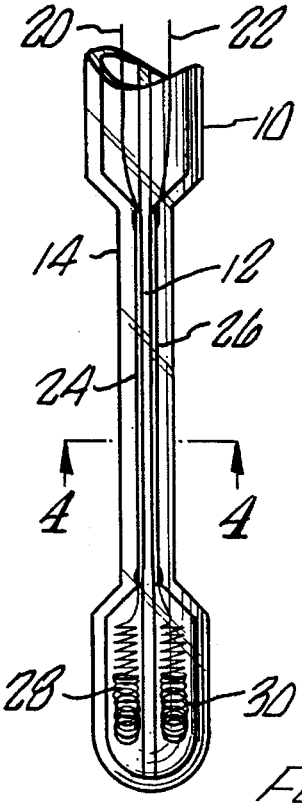
FIG. 2 is an end view of the lamp of FIG. 1.
Figure 4:
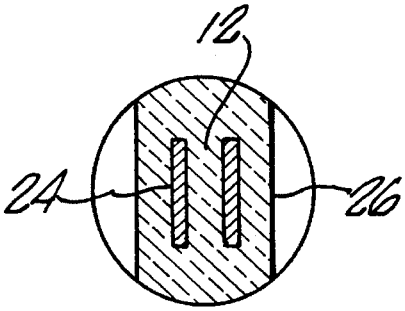
FIG. 4 is a cross-sectional view taken along line 4—4 of FIG. 2.

Turning in detail to the drawings, a lamp is disclosed in FIGS. 1 through 4. The lamp includes a tube 10. The tube is preferably of glass of 6.5 DBT (6.5 mm outside diameter double bore tubing). The tube 10 is elongate and has a septum 12 extending from at least a sealed portion 14 at a first end portion of the tube 10 near the terminal end to near a second or distal end 16 of the tube 10. Thus, an elongate cavity is provided within the tube which extends from the sealed portion 14 along either side of the septum 12 to meet and communicate at the distal end 16 around the end 18 of the septum 12. A cap 19 is located at the distal end 16 to close the tube 10.

Lead wires 20 and 22 extend into the sealed portion 14 of the sealed tube 10. The lead wires 20 and 22 are spot welded to leads 24 and 26. The leads 24 and 26 are thin conductive ribbons. The leads 24 and 26 are in turn spot welded to electrodes 28 and 30 which extend from the other end of the sealed portion 14.

The lamp is assembled by selecting a tube 10 with a septum 12 The tubes in this condition are open at both ends. A separate glass tube is welded to one end, the terminal end, of the tube 10. The electrode assemblies, consisting of the lead wires 20 and 22, the leads 24 and 26 and the coiled electrodes 28 and 30, respectively, are positioned with the septum 12 between the two assemblies. These assemblies are inserted from the distal end 16 of the tubing 10. The end cap 19 is placed on the end 16 of the tube 10 to close the end. The end cap 19 may be heated to make it integral with the body of the tube 10. A vacuum is then drawn on the terminal end of the tube 10 and an appropriate element such as mercury is injected. The filling mechanism includes the separate glass tube that is then closed off to provide a seal at the terminal end of the tube. The tube 10 thus is sealed at both ends with an appropriate vacuum and the electrodes positioned therein.

The electrodes 28 and 30 are positioned longitudinally within the sealed tube 10. With the electrodes positioned, the sealed portion is created by heating the glass about the portion 14. The vacuum within the tube 10 then shrinks the tube 10 in cross section so as to set the leads 24 and 26 and seal the entire lamp.

The tube is then heated and bent. The heating may be carefully performed such that the bending can take place without the tube 10 collapsing under the effect of the vacuum within the tube. However, with the electrodes properly positioned so that the ends Of the electrodes 28 and 30 extend toward the distal end 16 from the portion affected by the bend, a collapsing of the tube 10 at the bend has no effect on lamp operation. Thus, the electrodes can be physically crimped by the glass without effect. Once bent, the glass is annealed.

Once the seal is complete, the terminal end of the tube 10 may be cut off with the separate glass tube to expose the wire leads 20 and 22. With the lamp complete, testing may be performed.

With the electrodes 28 and 30 extending to between the bend and the distal end 16 of the tube 10, they are presented in the operative portion of the elongate cavity. This avoids lamp failure from closure of the tube in a way that the closure would seal off one or both of the electrodes 28 and 30 from the elongate cavity. The position of the electrodes 28 and 30 also avoids light generation in the bend.

Thus, an improved method of making and a resulting lamp are described. While embodiments and applications of this invention have been shown and described, it would be apparent to those skilled in the art that many more modifications are possible without departing from the inventive concepts herein. The invention, therefore, is not to be restricted except in the spirit of the appended claims. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A lamp comprising a sealed tube having an elongate cavity, the sealed tube having a first end portion, a second end and a septum extending from the first end portion to near the second end, the elongate cavity on both sides of the septum being sealed at the first end portion and joined at the second end, the sealed tube having a bend between the first end portion and second end of the sealed tube;

leads extending into the sealed tube at the first end portion;

electrodes coupled with the leads, respectively, and extending into the elongate cavity with the septum therebetween, the electrodes extending to between the bend and the second end in the sealed tube.

2. A lamp comprising a sealed tube having an elongate cavity, the sealed tube having a first end, a second end and a septum extending from the first end to near the second end, the elongate cavity on both sides of the septum being sealed at the first end and joined at the second end, the sealed tube having a bend between the first and second ends of the sealed tube, the bend being about 90°;

leads extending into the sealed tube;

electrodes coupled with the leads, respectively, and extending into the elongate cavity with the septum therebetween, the electrodes extending to between the bend and the second end in the sealed tube.

* * * * *